US007362281B2

(12) United States Patent
Huang et al.

(10) Patent No.: US 7,362,281 B2
(45) Date of Patent: Apr. 22, 2008

(54) PLANAR ANTENNA FOR RADIO FREQUENCY IDENTIFICATION TAG

(75) Inventors: Chi-Fang Huang, Taipei (TW); Jing-Qing Zhan, Taipei (TW)

(73) Assignees: Tatung Company, Taipei (TW); Tatung University, Taipei (TW)

( * ) Notice: Subject to any disclaimer, the term of this patent is extended or adjusted under 35 U.S.C. 154(b) by 0 days.

(21) Appl. No.: 11/557,500

(22) Filed: Nov. 8, 2006

(65) Prior Publication Data

US 2008/0001838 A1 Jan. 3, 2008

(30) Foreign Application Priority Data

Jun. 29, 2006 (TW) ..... 95123484 A

(51) Int. Cl.
*H01Q 9/28* (2006.01)
*H01Q 1/38* (2006.01)

(52) U.S. Cl. ..... 343/795; 343/700 MS

(58) Field of Classification Search ..... 343/700 MS, 343/795, 829
See application file for complete search history.

(56) References Cited

U.S. PATENT DOCUMENTS

| | | | | |
|---|---|---|---|---|
| 6,989,794 | B2 * | 1/2006 | Tran | 343/702 |
| 7,015,868 | B2 * | 3/2006 | Puente Baliarde et al. | 343/800 |
| 7,026,997 | B2 * | 4/2006 | Rahola | 343/700 MS |
| 7,113,141 | B2 * | 9/2006 | Almog et al. | 343/795 |
| 7,148,850 | B2 * | 12/2006 | Puente Baliarda et al. | 343/700 MS |
| 7,202,822 | B2 * | 4/2007 | Baliarda et al. | 343/700 MS |

* cited by examiner

*Primary Examiner*—Hoang V Nguyen
(74) *Attorney, Agent, or Firm*—Jianq Chyun IP Office

(57) ABSTRACT

A planar antenna for a radio frequency identification tag which receives or transmits an electromagnetic signal is provided. The planar antenna comprises a dielectric slab and a fractal dipole antenna. The height of the fractal dipole antenna is 0.3 to 0.7 times of the half wavelength of the electromagnetic signal, and the width of the fractal dipole antenna is 0.7 to 1.1 times of the half wavelength of the electromagnetic signal. The planar antenna achieves miniaturization and a good matching by utilizing the optimal size of the fractal dipole antenna.

16 Claims, 3 Drawing Sheets

PLANAR ANTENNA FOR RADIO FREQUENCY IDENTIFICATION TAG

CROSS-REFERENCE TO RELATED APPLICATION

This application claims the priority benefit of Taiwan application serial no. 95123484, filed on Jun. 29, 2006. All disclosure of the Taiwan application is incorporated herein by reference.

BACKGROUND OF THE INVENTION

1. Field of Invention

The present invention relates to a planar antenna. More particularly, the present invention relates to a planar antenna for a radio frequency identification (RFID) tag.

2. Description of Related Art

In recent years, RFID systems having the advantages of contactless identification, data security, and being capable of simultaneously reading multiple tags, have gradually replaced the current bar code tag systems. The RFID systems can be applied in very wide fields, such as access control cards, easy cards, and animal identification chips, and can be further applied in fields of logistics management, book management, and medical and drug administration, and so on.

An RFID system mainly comprises a reader system and a tag system. The reader system transmits the tag information to the tag system through an electromagnetic signal. The tag system receives or transmits the electromagnetic signal with a planar antenna, and discriminates the tag information carried by the electromagnetic signal with a tag chip, so as to decide whether or not to transmit the tag information back to the reader system. During the transmission of the tag information between the reader system and the tag system, whether the tag system has enough power to operate or whether the tag information can be transmitted back to the reader system depends on the conjugate match between the planar antenna and the tag chip. When the planar antenna and the tag chip have a good conjugate match, a maximum power transfer occurs between the planar antenna and the tag chip.

Generally, the tag system adopts a dipole antenna as the planar antenna. FIG. 1 is a schematic structural view of a conventional planar antenna. The conventional planar antenna 100 comprises a dielectric slab 110 and a dipole antenna 120, wherein the dipole antenna 120 is disposed on a surface 111 of the dielectric slab 110. However, as the size of the dipole antenna 120 of the conventional planar antenna 100 is too large, the miniaturization cannot be achieved.

In order to solve the above problem, an innovative planar antenna 200 adopts a dipole antenna and a fractal structure in the design of the planar antenna. FIG. 2 is a schematic structural view of the innovative antenna. In order to achieve the object of miniaturization, the innovative planar antenna 200 fragments the dipole antenna 120, such that this fractal dipole antenna has a fractal structure formed by fragmentation. The fractal structure refers to that the innovative fractal dipole antenna 210 is constituted of a plurality of sub-radiating elements (e.g., the sub-radiating elements 211-216 as shown in FIG. 2), and each of the sub-radiating elements has the same geometrical shape (e.g., the equilateral triangle). The width and height of the innovative fractal dipole antenna 210 are indicated by arrows as shown in FIG. 2. However, though the innovative planar antenna 200 is miniaturized, as the concept of the complex conjugate match is employed, the innovative planar antenna 200 cannot have a good conjugate match with the tag chip.

In view of the above, the innovative planar antennae cannot achieve the miniaturization and the conjugate match at the same time. In other words, when an RFID system is used with the innovative planar antenna which is not of conjugate match, the coverage of the identification distance thereof is limited, thus, they cannot be applied in systems practically.

SUMMARY OF THE INVENTION

The objective of the present invention is to provide a planar antenna for an RFID tag. Through the optimal design of the height and width of the fractal dipole antenna, the good conjugate match between the planar antenna and the tag chip and the miniaturization of the antenna can be achieved.

In order to achieve the aforementioned or other objectives, the present invention provides a planar antenna, which receives and transmits electromagnetic signals, for an RFID tag. The planar antenna comprises a dielectric slab and a fractal dipole antenna. The fractal dipole antenna is disposed on a surface of the dielectric slab, and comprises a signal-feed line set and two radiating elements. The two radiating elements are symmetrically disposed on the two sides of the signal-feed line set, wherein the radiating element on one side of the signal-feed line set is called a first radiating element, while the radiating element on the other side of the signal-feed line set is called a second radiating element.

Because the structure of the two radiating elements (the first radiating element and the second radiating element) of the fractal dipole antenna results from the iteration of a fractal algorithm, each of the two radiating elements comprises a fractal structure with an isosceles triangular boundary. Herein, the isosceles triangular boundary of the first radiating element is called a first isosceles triangular boundary, and the isosceles triangular boundary of the second radiating element is called a second isosceles triangular boundary.

For a fractal dipole antenna, the distance from the base edge of the first isosceles triangular boundary to the base edge of the second isosceles triangular boundary is the height of the fractal dipole antenna, while the width of the base edge of the first isosceles triangular boundary is the width of the fractal dipole antenna.

After many times of designs and experiments, the present invention finds when the height of the fractal dipole antenna is 0.3 to 0.7 times of the half wavelength of the electromagnetic signal, and the width of the fractal dipole antenna is 0.7 to 1.1 times of the half wavelength of the electromagnetic signal, the good conjugate match between the planar antenna of the present invention and the tag chip can be achieved.

On the other hand, after many times of designs and experiments, the present invention finds another optimal size for the fractal dipole antenna. That is, when the height of the fractal dipole antenna is 0.3 to 0.7 times of the half wavelength of the electromagnetic signal, and the width of the fractal dipole antenna is 1 to 2 times of the imaginary part of the impedance value of the tag chip, the good conjugate match between the planar antenna of the present invention and the tag chip can also be achieved. The width mentioned above is in the unit of millimeter, and the imaginary part of the impedance value of the tag chip mentioned above is in the unit of ohm.

It should be noted that the aforementioned dielectric slab may be a piece of paper and the material of the aforementioned fractal dipole antenna may be conductive printing ink. In other word, the planar antenna of the present invention can be printed by any current printing technique. Therefore, the planar antenna of the present invention has advantages of low cost and mass production.

To sum up, the present invention limits the length and width of the planar antenna according to the half wavelength of the electromagnetic signals received and transmitted by the planar antenna, or according to the imagery part of the impedance value of the tag chip. By doing this, better conjugate match between the planar antenna and the tag chip and the miniaturization of the antenna can be achieved.

In order to make the aforementioned and other objects, features and advantages of the present invention comprehensible, preferred embodiments accompanied with figures are described in detail below.

DESCRIPTION OF EMBODIMENTS

In order to achieve the miniaturization and conjugate match required by the planar antenna for an RFID tag, the present invention acquires the optimal size of the fractal dipole antenna through many times of designs and experiments. Compared to the innovative planar antennae, the planar antenna of the present invention not only has a miniature appearance, but also effectively improves the identification distance of the RFID system. The planar antenna of the present invention will be described below. However, the description is not intended to limit the present invention. Those skilled in the art can make appropriate modifications to the following embodiments without departing from the spirit of the present invention, and the modifications still fall in the scope of the present invention.

Figure 1:
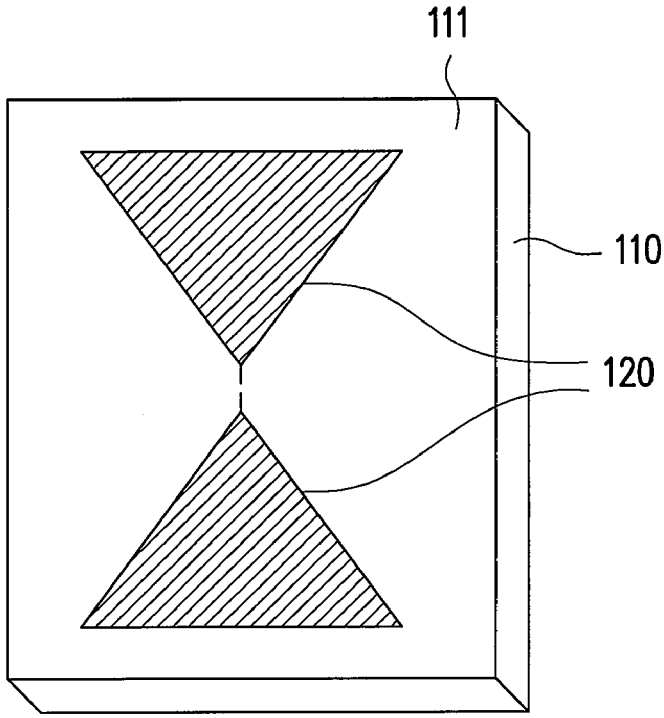
FIG. 1 (PRIOR ART)
FIG. 1 is a schematic structural view of a conventional planar antenna.
Figure 2:
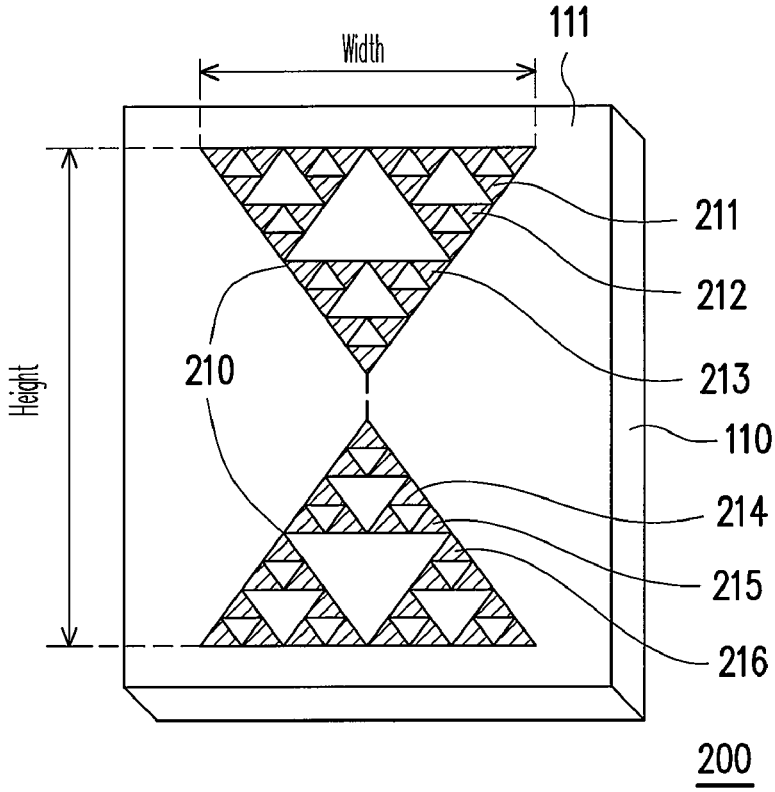
FIG. 2 is a schematic structural view of the innovative planar antenna.
Figure 3:
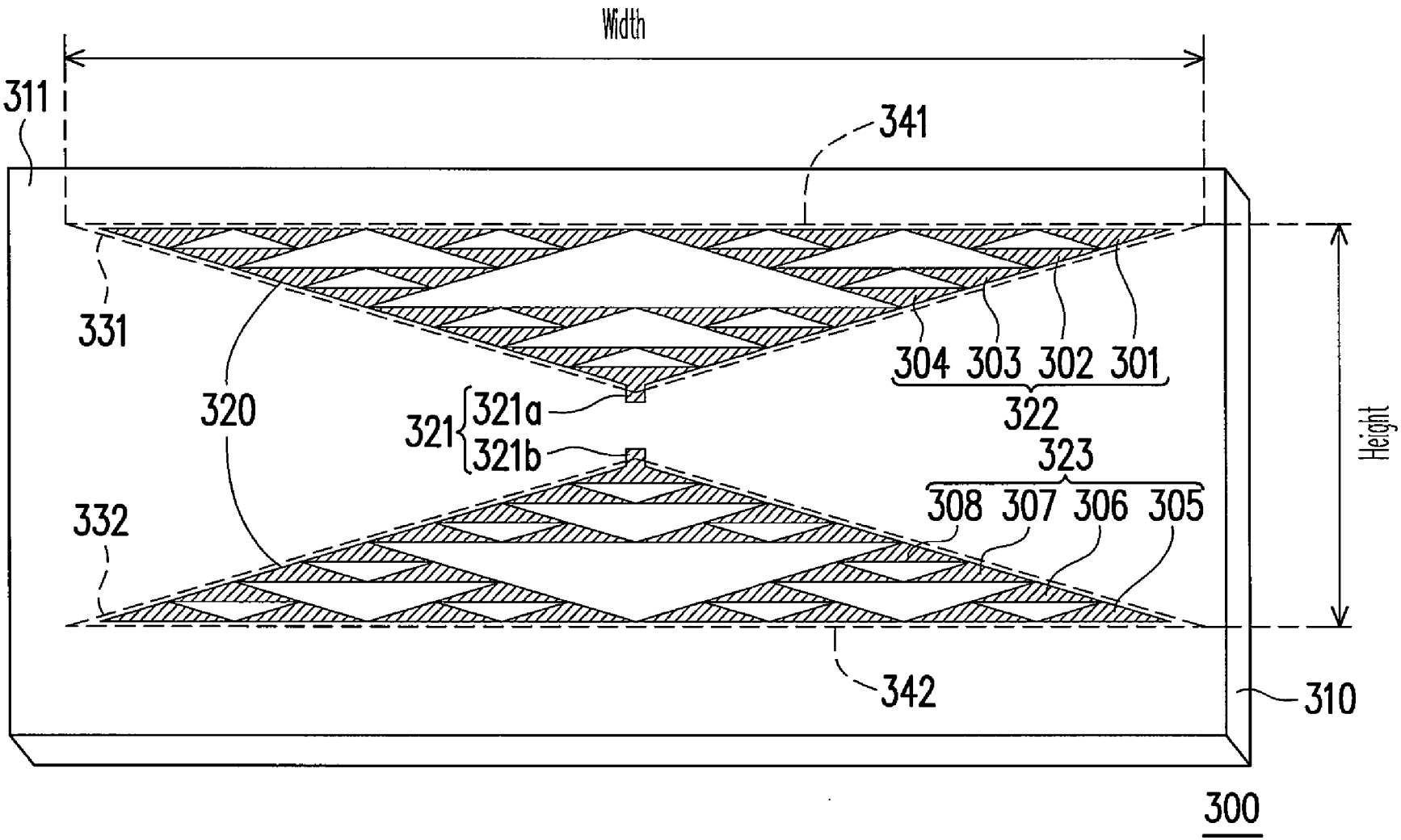
FIG. 3 is a schematic structural view of a planar antenna for an RFID tag according to an embodiment of the present invention.

FIG. 3 is a schematic structural view of a planar antenna for an RFID tag according to an embodiment of the present invention. The planar antenna 300 of the present embodiment comprises a dielectric slab 310 and a fractal dipole antenna 320. The fractal dipole antenna 320 is disposed on a surface 311 of the dielectric slab.

Figure 4:
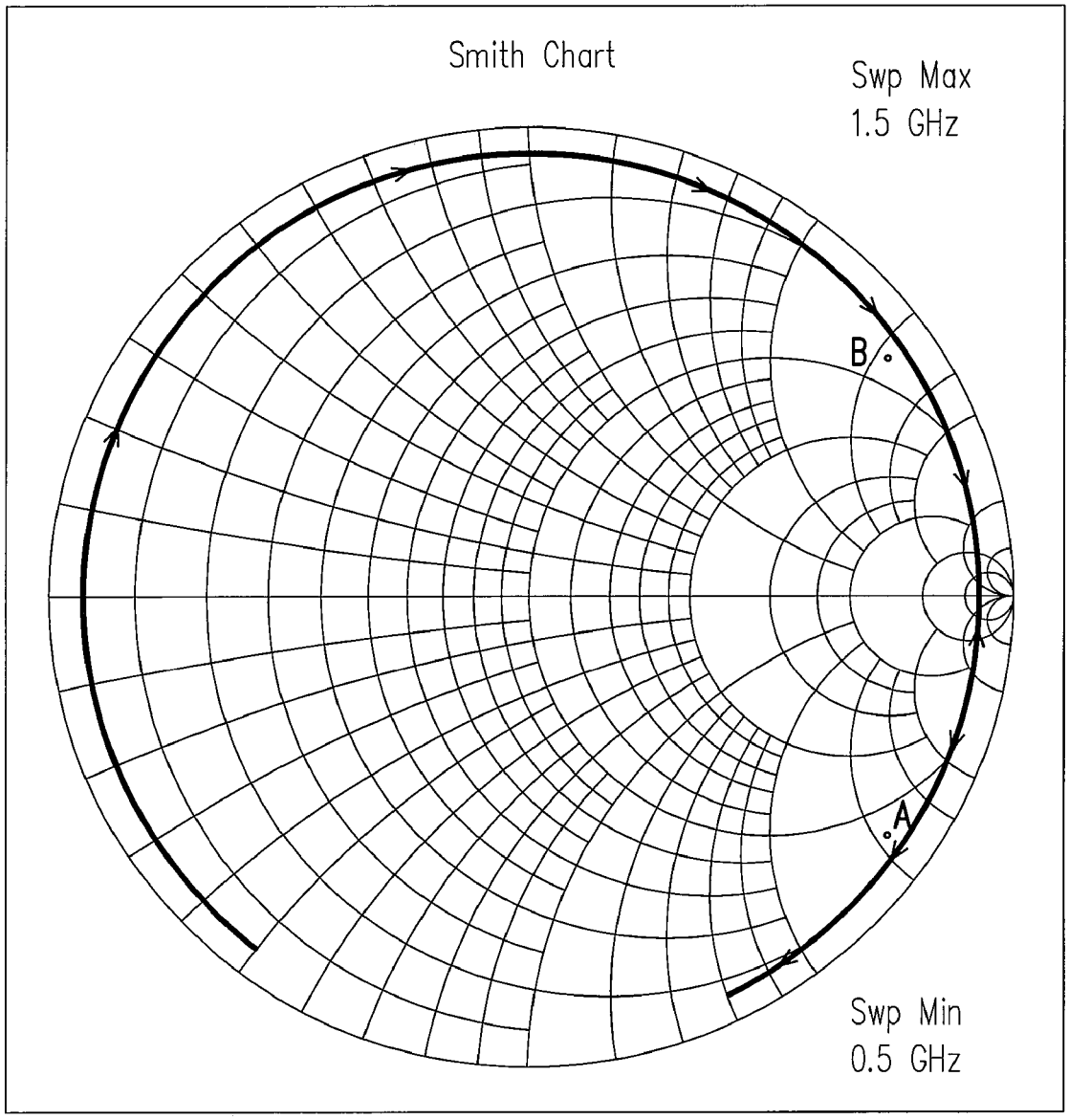
FIG. 4 is a Smith chart to illustrate the conjugate match of FIG. 3.

The planar antenna 300 is used to receive or transmit an electromagnetic signal. When the height of the fractal antenna 320 is 0.3 to 0.7 times of the half wavelength of the electromagnetic signal, and the width of the fractal antenna 320 is 0.7 to 1.1 times of the half wavelength of the electromagnetic signal, the planar antenna 300 have the optimal conjugate match in application. For example, for an RFID system operating in the frequency band of 915 MHz, if the planar antenna 300 is applied in the tag system, the conjugate match between the planar antenna 300 and the tag chip is as shown in FIG. 4. At this time, the impedance value of the tag chip is 6.7-j197.4Ω, shown as Point A in FIG. 4. The ideal conjugate match is shown as Point B in FIG. 4, in which the real part of the impedance value of the tag chip is the same as the real part of the impedance value of the planar antenna, and the imaginary part of the impedance value of the tag chip has the same absolute value but opposite sign as the imaginary part of the impedance value of the planer antenna. In other words, at this time, the conjugate match between the planar antenna 300 and the tag chip is optimal, such that the maximum power transfer occurs between the planar antenna 300 and the tag chip.

Moreover, after many times of designs and experiments, the present invention acquires the method to achieve the optimal complex conjugate of the planar antenna 300, which can also be achieved by another optimal size of the fractal dipole antenna. The optimal size of the fractal dipole antenna is that the height of the fractal dipole antenna 320 is 0.3 to 0.7 times of the half wavelength of the electromagnetic signal, and the width of the fractal dipole antenna 320 is 1 to 2 times of the imaginary part of the impedance value of the tag chip. The width is in a unit of millimeter, and the imaginary part of the impedance value of the tag chip is in a unit of ohm.

It should be noted that the material of the dielectric slab 310 comprise a PCB and paper. The fractal dipole 320 is a conductor, and the conductor comprises a metal conductor and conductive printing ink. The fractal dipole antenna 320 formed by the conductive printing ink can be printed by any current printing technique (such as offset printing, screen printing, intaglio printing, and relief printing techniques). Therefore, in addition to achieve the miniaturization and good conjugate match, the planar antenna of the present invention has advantages of low cost and mass production in practice.

Referring to FIG. 3 again, the fractal dipole antenna 320 comprises a signal-feed line set 321, a first radiating element 322, and a second radiating element 323. Wherein, the single feed line set 321 comprises signal-feed terminals 321*a* and 321*b*. A first edge of the first radiating element 322 is coupled to the signal-feed terminal 321*a* of the signal-feed line set 321. A first edge of the second radiating element 323 is coupled to the signal-feed terminal 321*b* of the signal-feed line set 321. The first radiating element 322 and the second radiating element 323 are symmetrically disposed on two sides of the signal-feed line set 321. In addition, the signal-feed line set 321, the first radiating element 322, and the second radiating element 323 are disposed on the surface 311 of the dielectric slab 310.

The fractal dipole antenna 320 is derived from a dipole antenna and a fractal structure. Therefore, the fractal dipole antenna 320 comprises a fractal structure. The fractal structure is included in the first radiating element 322 and the second radiating element 323, and means that the first radiating element 322 and the second radiating element 323 are respectively constituted of a plurality of sub-radiating elements, and each of the sub-radiating elements has the same geometrical shape.

In view of the above, the first radiating element 322 and the second radiating element 323 are described with reference to FIG. 3. The first radiating element 322 comprises a plurality of sub-radiating elements (only sub-radiating elements 301-304 are shown in FIG. 3). Each of the sub-radiating elements has an appearance of isosceles triangle, and all the sub-radiating elements in the first radiating element 322 define an isosceles triangular boundary 331. coupled to the signal-feed terminal 321*a* of the signal-feed line set 321, and the base edge of the isosceles triangular boundary 331 is the second edge 341 of the first radiating element 322. In other words, the vertex of the isosceles triangular boundary 331 is the first edge of the first radiating element 322.

Similarly, the second radiating element 323 comprises a plurality of sub-radiating elements (only sub-radiating elements 305-308 are shown in FIG. 3). Each of the sub-radiating elements has an appearance of isosceles triangle, and all the sub-radiating elements in the second radiating element 323 define an isosceles triangular boundary 332. The vertex of the isosceles triangular boundary 332 is coupled to the signal-feed terminal 321*b* of the signal-feed line set 321, and the base edge of the isosceles triangular boundary 332 is the second edge 342 of the second radiating element 323. In other words, the vertex of the isosceles triangular boundary 332 is the first edge of the first radiating element 323.

Viewed from the appearance of the first radiating element 322 and the second radiating element 323, the height of the fractal dipole antenna 320 is the distance from the second edge 341 of the first radiating element 322 to the second edge 342 of the second radiating element 323, and the width of the fractal dipole antenna 320 is the width of the second edge 341 of the first radiating element 322. However, viewed from another angle, the height of the fractal dipole antenna 320 is the distance from the base edge of the isosceles triangular boundary 331 to the base edge of the isosceles triangular boundary 332, and the width of the fractal dipole antenna 320 is the width of the base edge of the isosceles triangular boundary 331.

It should be noted that though a possible configuration of the fractal structure covered by the fractal dipole antenna is shown in the embodiment of FIG. 3, it should be understood by those skilled in the art that different fractal structures result in sub-radiating elements of different appearance. In other words, a fractal dipole antenna conforms to the spirit of the present invention as long as the fractal dipole antenna has a fractal structure and has an optimal size of the present invention.

To sum up, the present invention achieves the good conjugate match between the planar antenna and the tag chip and the miniaturization through the optimal design of the height and width of the fractal dipole antenna, for example, the optimal design of the fractal dipole antenna using the half wavelength of the electromagnetic signal, or the optimal design of the fractal dipole antenna using the half wavelength of the electromagnetic signal together with the imaginary part of the impedance value of the tag chip. Therefore, the identification distance of the RFID system is effectively improved.

It will be apparent to persons of ordinary skill in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A planar antenna for a radio frequency identification tag, which receives or transmits an electromagnetic signal, the planar antenna comprising:

a dielectric slab; and a fractal dipole antenna, disposed on a surface of the dielectric slab, wherein the height of the fractal dipole antenna is 0.3 to 0.7 times of the half wavelength of the electromagnetic signal, and the width of the fractal dipole antenna is 0.7 to 1.1 times of the half wavelength of the electromagnetic signal.

2. The planar antenna for a radio frequency identification tag as claimed in claim 1, wherein the fractal dipole antenna comprises:

a signal-feed line set for transmitting a signal;

a first radiating element, having a first isosceles triangular boundary, wherein the vertex of the first isosceles triangular boundary is coupled to the signal-feed line set; and a second radiating element, having a second isosceles triangular boundary, wherein the vertex of the second isosceles triangular boundary is coupled to the signal-feed line set, and the second radiating element and the first radiating element are symmetrically disposed on two sides of the signal-feed line set;

wherein the height of the fractal dipole antenna is the distance from a base edge of the first isosceles triangular boundary to a base edge of the second isosceles triangular boundary, and the width of the fractal dipole antenna is the width of the base edge of the first isosceles triangular boundary.

3. The planar antenna for a radio frequency identification tag as claimed in claim 2, wherein the signal-feed line set, the first radiating element, and the second radiating element are disposed on a same surface of the dielectric slab.

4. The planar antenna for a radio frequency identification tag as claimed in claim 1, wherein the dielectric slab is a printed circuit board (PCB).

5. The planar antenna for a radio frequency identification tag as claimed in claim 1, wherein the dielectric slab is a piece of paper.

6. The planar antenna for a radio frequency identification tag as claimed in claim 1, wherein the fractal dipole antenna is a conductor.

7. The planar antenna for a radio frequency identification tag as claimed in claim 6, wherein the conductor comprises a metal conductor and a conductive printing ink.

8. A planar antenna for a radio frequency identification tag, applicable to a tag chip to receive or transmit an electromagnetic signal, the planar antenna comprising:

a dielectric slab; and a fractal dipole antenna, disposed on a surface of the dielectric slab, wherein the height of the fractal dipole antenna is 0.3 to 0.7 times of the half wavelength of the electromagnetic signal, and the width of the fractal dipole antenna is 1 to 2 times of the imaginary part of the impedance value of the tag chip, and the width is in a unit of millimeter.

9. The planar antenna for a radio frequency identification tag as claimed in claim 8, wherein the fractal dipole antenna comprises:

a signal-feed line set for transmitting a signal;

a first radiating element, having a first isosceles triangular boundary, wherein the vertex of the first isosceles triangular boundary is coupled to the signal-feed line set; and a second radiating element, having a second isosceles triangular boundary, wherein the vertex of the second isosceles triangular boundary is coupled to the signal-feed line set, and the second radiating element and the first radiating element are symmetrically disposed on two sides of the signal-feed line set;

wherein the height of the fractal dipole antenna is the distance from a base edge of the first isosceles triangular boundary to a base edge of the second isosceles triangular boundary, and the width of the fractal dipole antenna is the width of the base edge of the first isosceles triangular boundary.

10. The planar antenna for a radio frequency identification tag as claimed in claim 9, wherein the signal-feed line set, the first radiating element, and the second radiating element are disposed on a same surface of the dielectric slab.

11. The planar antenna for a radio frequency identification tag as claimed in claim 8, wherein the dielectric slab is a PCB.

12. The planar antenna for a radio frequency identification tag as claimed in claim 8, wherein the dielectric slab is a piece of paper.

13. The planar antenna for a radio frequency identification tag as claimed in claim 8, wherein the fractal dipole antenna is a conductor.

14. The planar antenna for a radio frequency identification tag as claimed in claim 13, wherein the conductor comprises a metal conductor and a conductive printing ink.

15. A planar antenna for a radio frequency identification tag, which receives or transmits an electromagnetic signal, the planar antenna comprising:

a dielectric slab; and a fractal dipole antenna, disposed on a surface of the dielectric slab, wherein the height of the fractal dipole antenna is 0.3 to 0.7 times of the half wavelength of the electromagnetic signal, and the width of the fractal dipole antenna is 0.7 to 1.1 times of the half wavelength of the electromagnetic signal;

wherein the fractal dipole antenna comprises a first isosceles triangular boundary and a second isosceles triangular boundary, the height of the fractal dipole antenna is the distance from a base edge of the first isosceles triangular boundary to a base edge of the second isosceles triangular boundary, and the width of the fractal dipole antenna is the width of the base edge of the first isosceles triangular boundary.

16. A planar antenna for a radio frequency identification tag, applicable to a tag chip to receive or transmit an electromagnetic signal, the planar antenna comprising:

a dielectric slab; and a fractal dipole antenna, disposed on a surface of the dielectric slab, wherein the height of the fractal dipole antenna is 0.3 to 0.7 times of the half wavelength of the electromagnetic signal, and the width of the fractal dipole antenna is 1 to 2 times of the imaginary part of the impedance value of the tag chip, and the width is in a unit of millimeter;

wherein the fractal dipole antenna comprises a first isosceles triangular boundary and a second isosceles triangular boundary, the height of the fractal dipole antenna is the distance from a base edge of the first isosceles triangular boundary to a base edge of the second isosceles triangular boundary, and the width of the fractal dipole antenna is the width of the base edge of the first isosceles triangular boundary.

* * * * *